US007287736B2

(12) United States Patent
Hauck

(10) Patent No.: US 7,287,736 B2
(45) Date of Patent: Oct. 30, 2007

(54) COROLLA PLANT HANGER

(76) Inventor: Robert F. Hauck, 180 Claremont Dr., Morgan Hill, CA (US) 95037

( * ) Notice: Subject to any disclaimer, the term of this patent is extended or adjusted under 35 U.S.C. 154(b) by 175 days.

(21) Appl. No.: 10/997,505

(22) Filed: Nov. 24, 2004

(65) Prior Publication Data

US 2005/0279903 A1 Dec. 22, 2005

Related U.S. Application Data

(60) Provisional application No. 60/524,540, filed on Nov. 24, 2003.

(51) Int. Cl.
*A47H 1/10* (2006.01)

(52) U.S. Cl. ..... 248/318; 47/67

(58) Field of Classification Search ..... 248/322, 248/317, 318, 323, 324; 220/485, 660, 489; 47/67, 66.6, 40; D6/512–514, 403, 405; D11/143, 148; D26/9
See application file for complete search history.

(56) References Cited

U.S. PATENT DOCUMENTS 599,996 A * 3/1898 Engle ..... 47/67
1,815,195 A * 7/1931 Favata, Jr. ..... 47/67
2,064,826 A * 12/1936 Gabriel ..... 220/660
3,915,419 A * 10/1975 Brown et al. ..... 248/318
4,349,172 A * 9/1982 Banks, Jr. ..... 248/318
4,506,475 A 3/1985 Elliott
4,779,377 A 10/1988 Davis
4,956,937 A 9/1990 Haddox
5,329,728 A 7/1994 Ray
6,299,118 B1 10/2001 Farrell

* cited by examiner

*Primary Examiner*—Gwendolyn Baxter
(74) *Attorney, Agent, or Firm*—Donald E. Schreiber

(57) ABSTRACT

A plant hanger includes several generally C-shaped arms having apertures passing therethrough at opposite ends of each arm. The plant hanger also includes a first plurality of beads each of which has an aperture passing therethrough. The arms and the beads are secured together by a ring which passes both:

1. through one of the apertures which pass through each of the arms; and
2. through the apertures which pass through each of the beads.

Lastly, the plant hanger includes at least a pair of flexible belts. Each of the belts passes through more than half of the apertures which pass through each of the arms and are located at ends of the arms furthest from the apertures through which the ring passes. Moreover, both belts pass coincidently through apertures which pass through at least two (2) of the arms, which, preferably, are located on opposite sides of the plant hanger.

19 Claims, 3 Drawing Sheets

COROLLA PLANT HANGER

CLAIM OF PROVISIONAL APPLICATION RIGHTS

This application claims the benefit of U.S. Provisional Patent Application No. 60/524,540 filed on Nov. 24, 2003.

BACKGROUND OF THE INVENTION

1. Field of the Invention

The present invention relates generally to plant hangers, and, more particularly, to plant hangers assembled using rigid materials as contrasted with flexible materials such as twines or ropes.

2. Description of the Prior Art

U.S. Pat. No. 4,506,475 discloses a plant hanger that includes a support base comprised of a circular ring and a plurality of spokes which radiate outwardly beyond the ring and terminate in a hook. Chains connect to the hook at the end of each spoke to extend upwardly therefrom. A circular retainer ring, having a diameter which is greater than that of the support base and sufficiently large to surround the plant container, is positioned inside the chains and above the support base. The retainer ring can be positioned at various distances above the support base depending upon the height of the plant container. Ends of the chains extending above the retainer ring come together at a common juncture.

U.S. Pat. No. 4,779,377 discloses a plant hanger in which a plurality of thin, strong, flexible members, made from plastic, wire or the like, interconnect at a junction located beneath a plant container. An end of each member furthest from the junction includes a U-shaped hook that fits over and is secured to a rim 36 of the plant container, bending as necessary to conform to the outer shape of the plant container. A ring, connected to the thin, strong, flexible members at the junction thereof beneath the plant container, permits hanging a second plant container immediately beneath the first plant container.

U.S. Pat. No. 5,329,728 discloses a plant hanger assembled by securing about a plant container, or about a saucer upon which the plant container rests, several generally inverted U-shaped clips made from flat sheet material. A downwardly-facing surface of the plant container or saucer rests on a lower distal end of each clip. An upper distal end of each U-shaped clip seats against an inner surface of a plant container's or saucer's circular peripheral rim. One or a pair of apertures pierce a bight portion of each U-shaped clip near the top thereof so a bottom chain link may be affixed therein. The upper end of each of several chains are fixed into a common swivel, snap or S-type hook for attachment to a support nail or screw hook.

U.S. Pat. No. 4,956,937 discloses a plant hanger in which a ring joins together ends of a plurality of flexible straps join beneath a plant container. The straps extend radially outward from the ring across a base of the plant container, and then upward along an outer surface of the plant container. Upper ends of each strap are adapted for connection to a fixed support. The length of each strap is independently adjustable for varying the position of the plant container with respect to the fixed support.

BRIEF SUMMARY OF THE INVENTION

An object of the present invention is to provide a plant hanger made from rigid materials that may be packaged compactly.

Another object of the present invention is to provide a plant hanger made from rigid materials that may be shipped to a remote location via common or express carrier.

Another object of the present invention is to provide a plant hanger made from rigid materials that may be easily assembled at a remote location.

Yet another object of the present invention is to provide a plant hanger made from rigid materials which is easy to manufacture.

Yet another object of the present invention is to provide a plant hanger made from rigid materials which is economical to manufacture.

Yet another object of the present invention is to provide a plant hanger made from rigid materials which need not be assembled at its production facility.

Yet another object of the present invention is to provide a plant hanger made from rigid materials which is simple.

Yet another object of the present invention is to provide a plant hanger made from rigid materials which is durable.

Yet another object of the present invention is to provide a plant hanger made from rigid materials which is easy to maintain.

Briefly, a plant hanger in accordance with the present invention includes a plurality of rigid, generally C-shaped arms having apertures passing therethrough at opposite ends of each of the arms. The plant hanger also includes a first plurality of beads each of which has an aperture passing therethrough. The arms and the beads are secured together by a ring which passes both:

1. through one of the apertures that passes through each of the arms; and
2. through the apertures that passes through each of the beads.

Lastly, the plant hanger includes at least a pair of flexible belts. Each of the belts passes through more than half of the apertures that pass through each of the arms and that are located at ends of the arms which are furthest from the apertures through which the ring passes. Moreover, both of the belts pass coincidently through apertures which pass through at least two (2) of the arms, which preferably are located on opposite sides of the plant hanger.

The present invention also includes a method for assembling a plant hanger which includes the steps of:

1. passing a ring:
   a. through apertures that pass through a plurality of rigid, generally C-shaped arms, the apertures being located at an end of each arm; and
   b. through apertures that pass through each of a first plurality of beads; and
2. passing a pair of flexible belts through at least one aperture that passes through each of the plurality of arms.

The apertures through which the belts pass are located at an end of each arms furthest from the apertures through which the ring passes. Moreover, the arms having apertures passing therethrough through which the belts pass coincidently are preferably located on opposite sides of the plant hanger.

These and other features, objects and advantages will be understood or apparent to those of ordinary skill in the art from the following detailed description of the preferred embodiment as illustrated in the various drawing figures.

DETAILED DESCRIPTION

Figure 1:
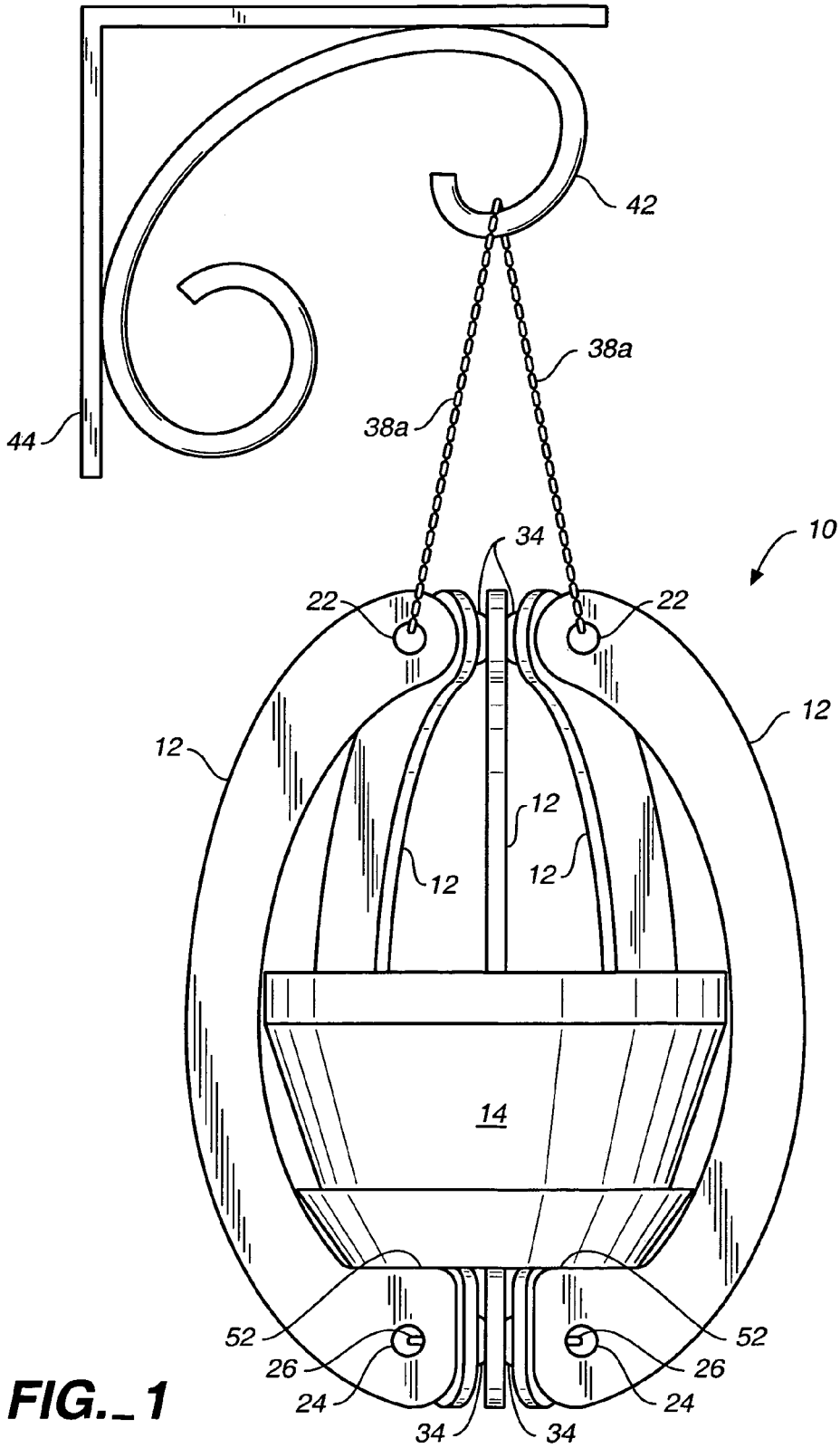
FIG. 1 is a partially sectioned, elevational view of a corolla plant hanger in accordance with the present invention that is assembled by securing together distal ends of a number of C-shaped arms.

FIG. 1 depicts an corolla plant hanger in accordance with the present invention referred to by the general reference character 10. The plant hanger 10 includes a number of rigid, generally C-shaped arms 12 that are adapted for encapsulating a plant growing in a flowerpot 14. Approximately half of the arms 12 included in the plant hanger 10 appear in the partially sectioned view of FIG. 1.

Figure 2:
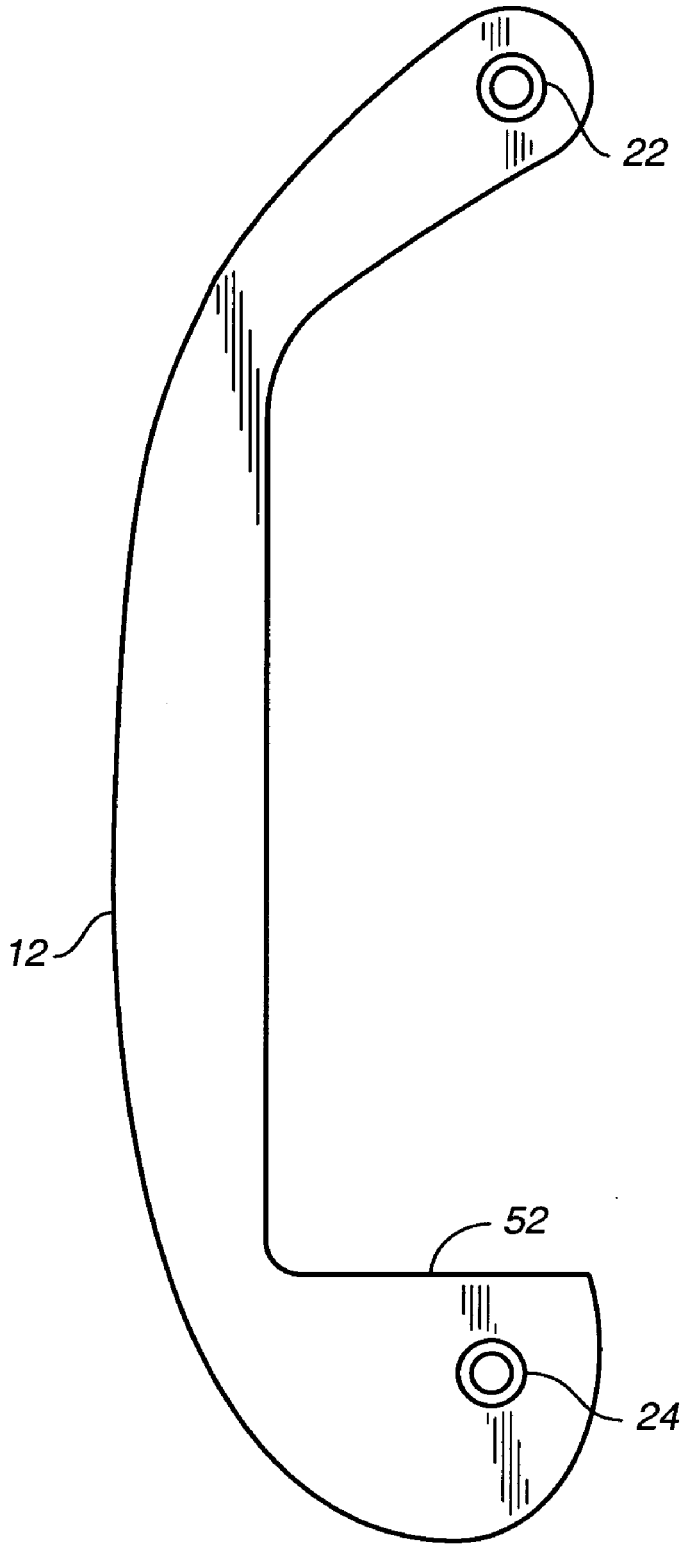
FIG. 2 is a plan view depicting one C-shaped arm included in the corolla plant hanger depicted in FIG. 1.

As better illustrated in FIG. 2, opposite ends of each arm 12 include flared holes 22, 24 formed in side surfaces of each arm 12 which are preferably approximately one-half (½) inch in diameter. Other holes may also pass through the arms 12, particularly for securing raw material for machining if a numerically-controlled carver is used in fabricating the arms 12. Such additional holes through the arms 12 are left as a design choice.

Referring again to FIG. 1, at the base of the assembled plant hanger 10 a stiff ring 26, preferably metallic, passes through the holes 24 in all the arms 12. The ring 26 also passes through approximately one-quarter (¼) inch diameter holes 32 that pass through large, spherically-shaped beads 34.

Figure 4:
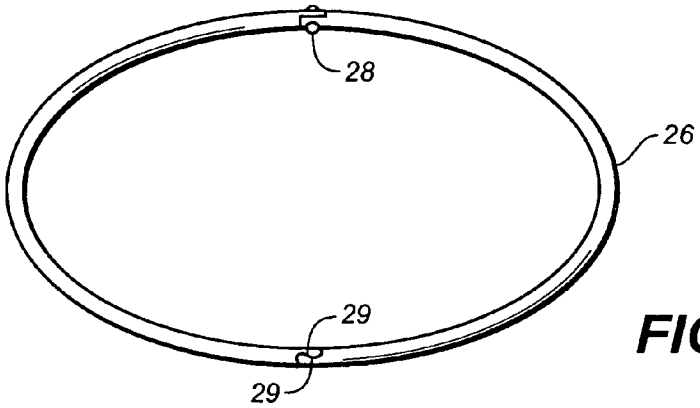
FIG. 4 is a perspective view of a preferred ring which passes through holes in all the C-shaped arms, illustrated in FIG. 2, of the corolla plant hanger, illustrated in FIG. 1, that are located at the base thereof.

The ring 26 is preferably circular and of a diameter appropriate for accommodating a particular size of planter pot. As depicted in FIG. 4, the ring 26 is preferably a standard ring-binder type metal loop used for binding hole-punched papers. The loop spreads apart about a midpoint pivot pin 28, and opposing hooks 29 on the open ends thereof lock together when the loop is closed. A ring 26 of the type depicted in FIG. 4 is easily threaded through the arms 12 and beads 34 and easily closed. The ring 26 can be rotated slightly, after closing, so that both the pivot pin and hook-end closure point are hidden within opposing beads 34 for an aesthetically pleasing appearance.

The number of beads 34 respectively disposed along the ring 26 is no less than and preferably equals the number of arms 12 included in the plant hanger 10. Arranged along the ring 26 in this way, the beads 34 radially separate immediately adjacent pairs of arms 12 uniformly at the base of the plant hanger 10. The flares around the holes 24 help position each of the beads 34 uniformly between a pair of the arms 12 when the base of the plant hanger 10 is compact. Use of a stiff metal ring 26 makes the base of the plant hanger 10 rigid which prevents the arms 12 at the base of the plant hanger 10 from drooping when the plant hanger 10 is hung as illustrated in FIG. 1.

Figure 3:
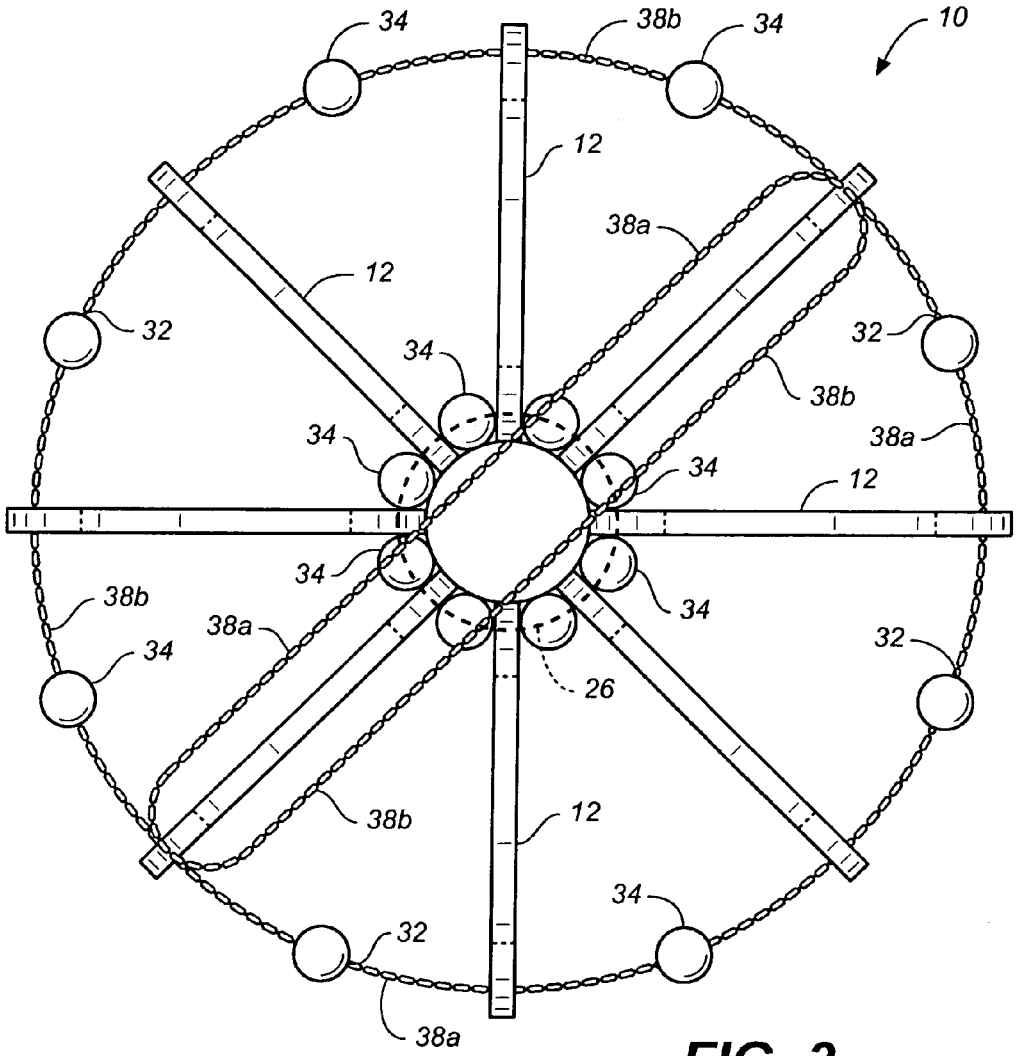
FIG. 3 is a plan view depicting the corolla plant hanger of FIG. 1 such as when open and resting on a table or the ground.

As best illustrated in FIG. 3, for suspending the plant hanger 10 two (2) flexible belts 38*a* and 38*b*, preferably made from beaded brass pull-chain, respectively loop through one more than half of the holes 22 that pass through the arms 12 at the top of the plant hanger 10. That is, for at least two (2) of the arms 12 which are located on diametrically opposite sides of the plant hanger 10 both of the belts 38*a* and 38*b* pass coincidently through holes 22 that pass through those arms 12. Only one pull chain 38*a* or 38*b* passes through the holes 22 that pass through the other arms 12 included in the plant hanger 10.

Each pull chain 38*a*, 38*b* also passes respectively through approximately one-quarter (¼) inch diameter holes 32 that pass through beads 34. Similar to the base of the plant hanger 10, the number of beads 34 respectively disposed along the belts 38*a* and 38*b* is no less than and preferably equals the number of arms 12 included in the plant hanger 10. Arranged along the belts 38*a* and 38*b* in this way, the beads 34 separate immediately adjacent pairs of arms 12 at the top of the plant hanger 10.

Each pull chain 38*a*, 38*b* also passes respectively through approximately one-quarter (¼) inch diameter holes 32 that pierce beads 34. Similar to the base of the plant hanger 10, the number of beads 34 respectively disposed along the belts 38*a* and 38*b* is no less than and preferably equals the number of arms 12 included in the plant hanger 10. Arranged along the belts 38*a* and 38*b* in this way, the beads 34 separate immediately adjacent pairs of arms 12 at the top of the plant hanger 10.

The belts 38*a* and 38*b* are preferably made of beaded brass pull-chain because it is strong, non-corrosive, flexible and can be cut to any desired length and easily refastened. Many other materials such as wires, strings, ropes, nylon-cables or stranded-cables can be used instead of chain for the belts 38*a* and 38*b*. However, an important aesthetic consideration for the plant hanger 10 is an ability to unobtrusively re-attach ends of the belts 38*a* and 38*b* to form a closed loop. For the preceding reason, beaded pull-chains are preferred for securing ends of all arms 12 at the top of the plant hanger 10.

The two (2) belts 38*a* and 38*b* operate similar to a pull-strings on a money-bag. That is, when those segments of the belts 38*a* and 38*b* which extend diametrically across the plant hanger 10 parallel to each other are drawn upward above the plant hanger 10, ends of the arms 12 through which the holes 22 pass gather together to close up and encapsulate the flowerpot 14. The lengths of the belts 38*a* and 38*b* extending above the plant hanger 10 may then be hung on a hook 42 included in a bracket 44 with the arms 12 tightly encapsulating the flowerpot 14.

When the plant hanger 10 is closed as illustrated in FIG. 1, the flare of the holes 22 aligns the beads 34 therewith. The flare of the holes 22 also facilitates a smooth flow of the belts 38*a* and 38*b* through the arms 12 and the holes 32 which pass through the beads 34 when closing the plant hanger 10 to encapsulate the flowerpot 14. The beads 34 at the top of the plant hanger 10 keep the arms 12 uniformly separated when the plant hanger 10 is in its closed-up configuration.

As illustrated in FIG. 3, the belts 38*a* and 38*b* may in some instances be sufficiently long that the arms 12 fall radially open when the belts 38*a* and 38*b* are removed from the hook 42 and the plant hanger 10 rests on a table or the ground. Arranged in this open configuration, the portions of the two (2) belts 38*a* and 38*b* which cross the open plant hanger 10 between diametrically opposite arms 12 are sufficiently flexible that a potted plant may be easily placed into or removed from the center of the plant hanger 10.

The plant hanger 10 is preferably configured so a plant protrudes through the arms 12 to exhibit its full foliage unobstructed. To achieve this result, the arms 12 must be sufficiently long, at least twice the height of the flowerpot 14 without the plant. For larger planters, such long arms 12 present a problem for the length of the belts 38*a* and 38*b*. If as depicted in FIG. 3 the belts 38*a* and 38*b* are sufficiently long to allow the arms 12 to fall flat when a larger plant hanger 10 is opened, the belts 38*a* and 38*b* will generally be too long for hanging the plant hanger 10 on the hook 42 in its closed configuration. This difficulty is resolved by letting the hanging configuration take precedence and using belts 38*a* and 38*b* having a shorter length which does not permit the plant hanger 10 to open fully. When the plant hanger 10 is of a medium-size or larger, the arms 12 are sufficiently heavy that they hold the plant hanger 10 open in a radially balanced position and the potted plant can still pass to one side of the belts 38*a* and 38*b* where they extend in parallel across the larger plant hanger 10 between diametrically opposite arms 12.

The functionality of the plant hanger 10 does not depend on a particular number of arms 12. However, an even number of arms 12 increases balance for a plant hanger 10 assembled with a lesser number of arms 12. A plant hanger 10 assembled with eight (8) arms 12 works well for a medium-size flowerpot 14. A plant hanger 10 having six (6) arms 12 works well with a smaller flowerpot 14. A larger flowerpot 14 may require twelve (12) or more arms 12 to be safely supported. It is conceivable that perhaps as many as thirty-two (32) arms 12 might be needed to encapsulate a particularly large potted plant.

Although unnecessary to their function, the arms 12 are preferably given an architectural sculpture on the exterior (convex) surface of their C-shape to make them visually attractive. However, as depicted in FIG. 2 interior surfaces near the bottom of each of the arms 12 are formed with an extended foot 52 which in the closed plant hanger 10 extends radially inward toward the center of the plant hanger 10. Collectively, when the plant hanger 10 is closed the feet 52 of all the arms 12 provide a base upon which the flowerpot 14 rests.

Although various different materials may be used in fabricating the plant hanger 10, e.g. wood, aluminum, or hollow PVC-plastic, the preferred material for the arms 12 and beads 34 is solid, high-density polyethylene ("HDPE"). HDPE processes very easily and finishes nicely with a smooth sheen surface. HDPE has a life expectancy of at least 50 years, and in outdoor use survives extremes of weather and climate.

The configuration of the plant hanger 10 when disassembled permits compact packaging, and easy assembly at a remote location with minimal instructions. This characteristic of the plant hanger 10 greatly facilitates its sale via the Internet and its shipment to remote locations via common or express carrier, such as the United States Postal Service ("USPS"), United Parcel Service ("UPS"), Federal Express, etc. This characteristic of the plant hanger 10 also eliminates any requirement for assembly at the production facility.

Although the present invention has been described in terms of the presently preferred embodiment, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A plant hanger comprising:

a plurality of rigid, generally C-shaped arms having apertures passing therethrough at opposite ends of each of the arms;

a first plurality of beads each of which has an aperture passing therethrough;

a ring which passes both:

i. through one of the apertures which pass through each of said arms; and ii. through the apertures which pass through each of said beads; and at least a pair of flexible belts, each of which passes through more than half of the apertures which pass through each of said arms and that are located at ends of said arms which are furthest from the apertures through which said ring passes, both of the belts passing coincidently through the apertures which pass through at least two (2) of said arms.

2. The plant hanger of claim 1 wherein the first plurality of beads equals in number the plurality of arms with each of said beads being disposed between a pair of immediately adjacent arms.

3. The plant hanger of claim 2 wherein the apertures which pass through each of said arms through which said ring passes include a flare formed on both side surfaces of each arm for receiving a portion of said beads disposed adjacent thereto.

4. The plant hanger of claim 1 wherein said beads are spherically-shaped.

5. The plant hanger of claim 1 wherein said ring is formed as a loop which can be spread apart about a midpoint pivot pin, and having opposing hooks formed on open ends thereof which lock with each other upon closing the open ends together.

6. The plant hanger of claim 1 wherein the apertures which pass through said arms through which said ring passes include a flare formed in a side surface of said arm for receiving a portion of said beads disposed adjacent thereto.

7. The plant hanger of claim 1 wherein said belts are formed by a material selected from a group consisting of beaded pull-chain, chain, wire, string, rope, nylon-cable and stranded-cable.

8. The plant hanger of claim 1 wherein the apertures:

a. that pass through ends of said arms furthest from the apertures through which said ring passes; and b. through which both of the belts pass coincidently; are located on diametrically opposite sides of the plant hanger.

9. The plant hanger of claim 1 further comprising a second plurality of beads each of which has an aperture passing therethrough with one of said belts passing through the aperture which passes through each of said beads of the second plurality.

10. The plant hanger of claim 9 wherein the beads of the second plurality equal in number the plurality of arms with each of said beads of the second plurality being disposed between a pair of immediately adjacent arms.

11. The plant hanger of claim 10 wherein the apertures which pass through each of said arms through which said belts pass include a flare formed on both side surfaces of each arm for receiving a portion of said bead of the second plurality disposed adjacent thereto.

12. The plant hanger of claim 9 wherein said beads of the second plurality are spherically-shaped.

13. The plant hanger of claim 9 wherein the apertures which pass through said arms through which said belt passes include a flare formed in a side surface of said arm for receiving a portion of said bead of the second plurality disposed adjacent thereto.

14. A method for assembling a plant hanger comprising the steps of:

passing a ring:

i. through apertures that pass through a plurality of rigid, generally C-shaped arms, the apertures being located at an end of each arm; and ii. through apertures that pass through each of a first plurality of beads; and passing a pair of flexible belts through at least one aperture that passes through each of the plurality of arms, the apertures through which the belts pass being located at an end of each arms furthest from the apertures through which said ring passes, both of the belts passing coincidently through apertures which pass through at least two (2) of the arms.

15. The method of claim 14 wherein the beads of the first plurality equal in number the plurality of arms, and wherein the method steps include placing each of said beads of the first plurality between a pair of immediately adjacent arms.

16. The method of claim 14 wherein the apertures passing through the arms through which the pair of flexible belts pass coincidently are located on diametrically opposite sides of the plant hanger.

17. The method of claim 14 further comprising the step of selecting a material for said belts from a group consisting of beaded pull-chain, chain, wire, string, rope, nylon-cable and stranded-cable.

18. The method of claim 14 further comprising the step of passing each of said belts through an aperture each of which respectively passes through a second plurality of beads.

19. The method of claim 18 wherein the beads of the second plurality equal in number the plurality of arms, and wherein each of said beads of the second plurality is disposed between a pair of immediately adjacent arms.

* * * * *